US007617807B2

(12) United States Patent
Diggs et al.

(10) Patent No.: US 7,617,807 B2
(45) Date of Patent: Nov. 17, 2009

(54) ENGINE AND VALVETRAIN WITH DUAL PUSHROD LIFTERS AND INDEPENDENT LASH ADJUSTMENT

(75) Inventors: Matthew Diggs, Farmington, MI (US); Wally Beaber, Northville, MI (US); Robert Innes, Howell, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 229 days.

(21) Appl. No.: 11/164,620

(22) Filed: Nov. 30, 2005

(65) Prior Publication Data

US 2007/0119397 A1 May 31, 2007

(51) Int. Cl.
*F01L 1/14* (2006.01)

(52) U.S. Cl. ..... 123/90.48; 123/90.39; 123/90.44; 123/90.61; 123/90.52

(58) Field of Classification Search ..... 123/90.48, 123/90.22, 90.39, 90.4, 90.41, 90.43, 90.44, 123/90.52, 90.6, 90.61, 90.63, 90.55, 90.45, 123/90.46; 74/559, 567, 569
See application file for complete search history.

(56) References Cited

U.S. PATENT DOCUMENTS

| | | | | |
|---|---|---|---|---|
| 2,957,461 | A | 10/1960 | Carpentier | |
| 3,353,523 | A * | 11/1967 | Meden et al. | 123/54.4 |
| 3,757,749 | A * | 9/1973 | Hatz | 123/90.22 |
| 3,884,199 | A * | 5/1975 | Irimajiri et al. | 123/90.61 |
| 4,393,820 | A | 7/1983 | Maki et al. | |
| 4,476,822 | A | 10/1984 | Bonvallet | |
| 4,510,897 | A | 4/1985 | Hatz et al. | |
| 4,763,616 | A | 8/1988 | Grinsteiner | |
| 4,934,323 | A | 6/1990 | Grinsteiner | |
| 5,022,361 | A | 6/1991 | Schut | |
| 5,038,726 | A | 8/1991 | Pryba | |
| 5,213,074 | A * | 5/1993 | Imagawa et al. | 123/196 M |
| 5,560,265 | A | 10/1996 | Miller | |
| 5,617,818 | A | 4/1997 | Luders | |
| 5,657,726 | A | 8/1997 | Diggs | |
| 5,732,670 | A * | 3/1998 | Mote, Sr. | 123/90.24 |
| 5,809,956 | A | 9/1998 | Regueiro | |
| 5,862,785 | A | 1/1999 | Blowers et al. | |
| 5,983,849 | A * | 11/1999 | Wangen et al. | 123/90.61 |
| 6,047,675 | A | 4/2000 | Kunz | |

(Continued)

FOREIGN PATENT DOCUMENTS

| | | |
|---|---|---|
| GB | 716828 | 10/1954 |
| GB | 1036490 | 7/1966 |

OTHER PUBLICATIONS

Uk Search report in GB0706889.3 dated Jul. 19, 2007.

*Primary Examiner*—Ching Chang
(74) *Attorney, Agent, or Firm*—Julia Voutyras; Brooks Kushman P.C.

(57) ABSTRACT

A multiple cylinder internal combustion engine having a camshaft-driven valvetrain with a camshaft disposed within an engine block includes at least two intake and/or exhaust valves with a pair of valves operated by a common camshaft lobe and a cam follower. The valvetrain may include independently operable mechanical or hydraulic lash adjusters. The cam follower contacts the common camshaft lobe and at least two pushrods with each pushrod having an associated single plane rocker arm which couples to a fulcrum mounted to the cylinder head to actuate the at least two valves.

19 Claims, 3 Drawing Sheets

U.S. PATENT DOCUMENTS

| | | | | |
|---|---|---|---|---|
| 6,273,042 | B1 | 8/2001 | Perez et al. | |
| 6,484,682 | B2 | 11/2002 | Danesh et al. | |
| 6,505,589 | B1 * | 1/2003 | Hayman et al. | 123/90.23 |
| 6,513,472 | B2 | 2/2003 | Speil et al. | |
| 6,659,056 | B2 | 12/2003 | Sweetland | |
| 6,953,016 | B2 | 10/2005 | Karbstein et al. | |
| 6,962,134 | B1 | 11/2005 | Douse | |
| 7,096,850 | B2 * | 8/2006 | Yashirodai et al. | 123/317 |
| 7,134,411 | B2 * | 11/2006 | Lancefield et al. | 123/90.4 |
| 2005/0056242 | A1 | 3/2005 | Murata et al. | |

* cited by examiner

ENGINE AND VALVETRAIN WITH DUAL PUSHROD LIFTERS AND INDEPENDENT LASH ADJUSTMENT

BACKGROUND OF THE INVENTION

1. Field of the Invention

The present invention relates to multiple cylinder internal combustion engines having intake/exhaust valves operated by a camshaft positioned in an engine block with an associated valvetrain.

2. Background Art

Conventional internal combustion engines use a camshaft-driven valvetrain to operate intake and exhaust valves that control the exchange of gases in the combustion chambers formed between the engine block and cylinder head. Engines are often categorized by the location of the camshaft relative to the valves, with overhead cam valvetrains driven by a camshaft in the cylinder head over the valves, and pushrod valvetrains or "cam-in-block" valvetrains having the camshaft located in the engine block with the valves operated using pushrods and rocker arms.

Current four-valve-per-cylinder pushrod engines include two intake valves and two exhaust valves for each cylinder. Each pair of valves is operated in tandem by a bridged valvetrain that includes a camshaft driven cam follower (also referred to as a tappet or lifter) connected by a single pushrod to a rocker arm that drives a bridge coupled to the pair of valves (intake or exhaust). The bridged valvetrain is a cost-efficient design that achieves acceptable performance for many applications, although operation of the two bridged valves is not precisely synchronized because the force exerted on the bridge can not be perfectly balanced between the valves, the valves may have slightly different spring forces, and the valve components may experience slightly different wear. This may result in one valve opening late and/or at valve closure, one valve may seat first causing the other valve to seat late with a higher than intended velocity. In addition, valve stem tips are edge loaded by the bridge with higher stresses resulting in higher rates of wear and potential noise, vibration, and harshness (NVH) concerns. While single overhead cam (SOHC) and dual overhead cam (DOHC) systems have independently controlled valves to address some of these issues, the SOHC and DOHC systems are significantly more expensive and have large package width relative to a cam-in-block design.

SUMMARY OF THE INVENTION

A multiple cylinder internal combustion engine having a camshaft-driven valvetrain with a camshaft disposed within an engine block includes at least two valves operated by a common camshaft lobe and an associated cam follower coupled to at least two pushrods and rocker arms to actuate the at least two valves.

Embodiments of the present invention include a lifter having independent dual hydraulic lash adjusters for driving two valves associated with a single cylinder in tandem. Single plane stamped-steel rocker arms facilitate packaging of two followers and four pushrods per cylinder for four valve per cylinder engine applications.

A method for actuating at least two gas exchange valves associated with a single cylinder in a multiple cylinder internal combustion engine having a camshaft disposed within an engine block according to the present invention includes actuating the at least two gas exchange valves substantially simultaneously using at least two corresponding pushrods and rocker arms coupled to a common cam follower. The common cam follower may independently adjust lash associated with each pushrod and rocker arm.

The present invention provides a number of advantages. For example, the present invention provides embodiments with a dedicated lash adjuster for each valve associated with a particular lifter to compensate for thermal, wear, and tolerance effects and to insure that the valve motion remains very close to the design intent throughout the life of the engine. A common lifter for tandem valve operation with independent lash adjusters according to the present invention should reduce or eliminate noise, vibration, and harshness associated with valve pairs failing to open or close together and/or having different or higher than intended seating velocities. The present invention provides coupled, synchronous motion for each valve pair and allows individual compensation for valve spring force differences, differences in valve/seat wear, and differences due to the rocker arm force not being applied at the mid-point between valve centerlines which is liable to occur using a valve bridge design, for example. In addition, the present invention eliminates wear mechanisms associated with bridged valvetrain implementations, such as pitching and rolling of the bridge resulting in increased stresses on the bridge/rocker arm interface resulting in undesirable contact between the bridge and valve stem tips. Use of single plane stamped steel rocker arms having a ball/socket pivot according to the present invention facilitate packaging while reducing moving mass and increasing valve gear natural frequency. The ball/socket pivot point can be placed so that one rocker arm is significantly longer than the other rocker arm of a valve pair, but the rocker ratios are substantially identical to provide substantially identical valve open, close, and peak lift points.

The above advantages and other advantages and features of the present invention will be readily apparent from the following detailed description of the preferred embodiments when taken in connection with the accompanying drawings.

DETAILED DESCRIPTION OF THE PREFERRED EMBODIMENT(S)

As those of ordinary skill in the art will understand, various features of the present invention as illustrated and described with reference to any one of the Figures may be combined with features illustrated in one or more other Figures to produce embodiments of the present invention that are not explicitly illustrated or described. The combinations of features illustrated provide representative embodiments for typical applications. However, various combinations and modifications of the features consistent with the teachings of the present invention may be desired for particular applications or implementations.

Figure 1:
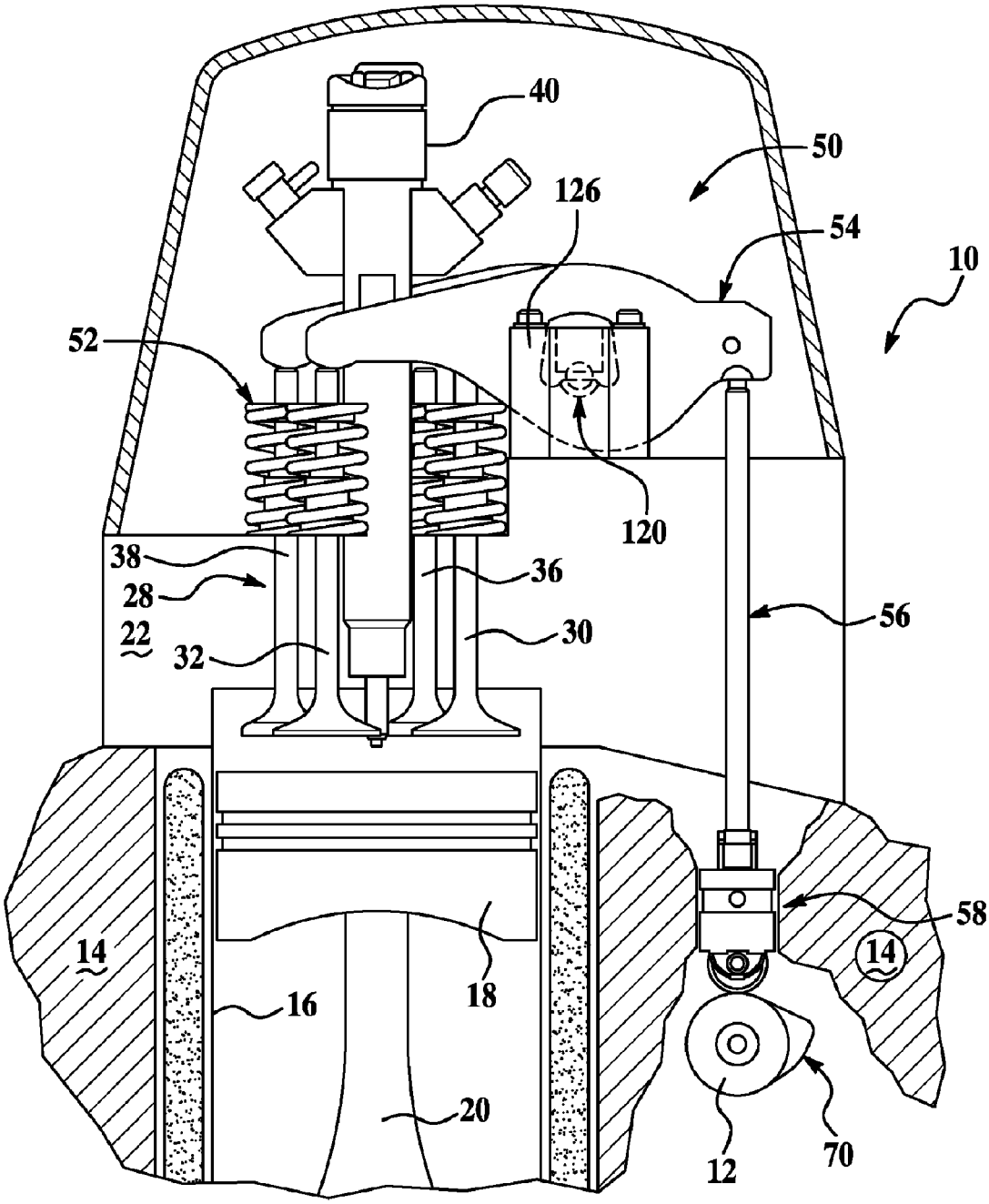
FIG. 1 illustrates a valvetrain with dual lifter in an internal combustion engine according to one embodiment of the present invention.
Figure 2:
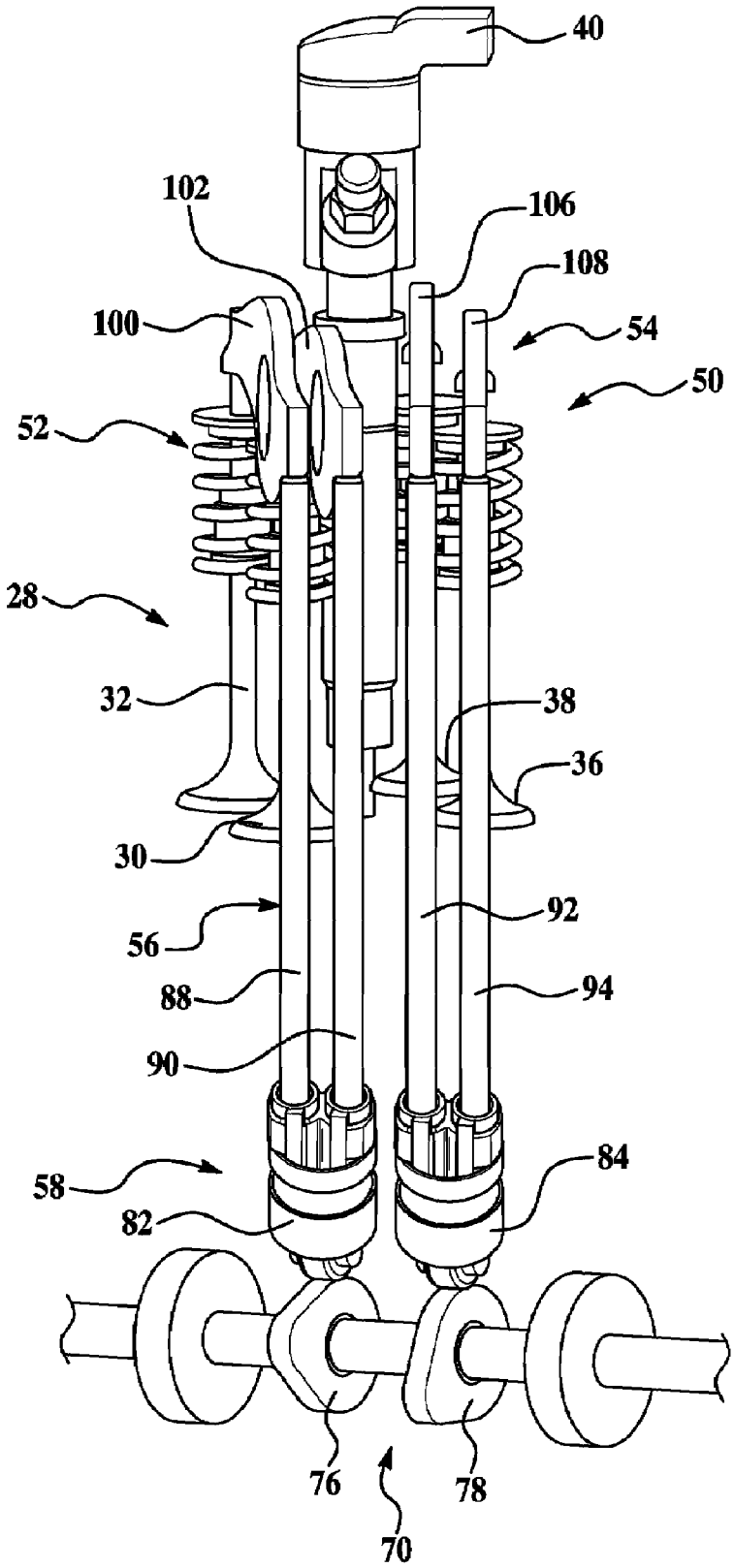
FIG. 2 is a perspective view of a representative four valve per cylinder valvetrain according to one embodiment of the present invention.
Figure 3:
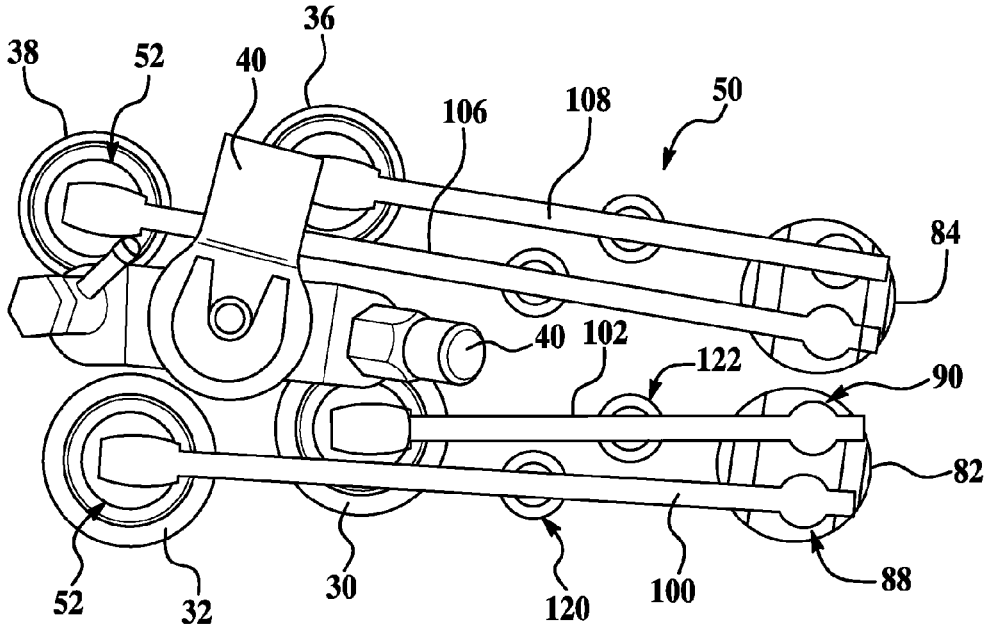
FIG. 3 is a top view of a representative four valve per cylinder valvetrain according to one embodiment of the present invention.

FIGS. 1-3 illustrate operation of an internal combustion engine and valvetrain according to a representative embodiment of the present invention. Multiple cylinder internal combustion engine 10 is generally of conventional design with the exception of various valvetrain components as described herein. As such, various conventional features associated with the engine and valvetrain are not explicitly illustrated or described. Those of ordinary skill in the art will recognize that the present invention may be used in various types and configurations of engines including but not limited to compression ignition and spark ignition engines arranged in a "V" configuration or an in-line configuration, for example. The representative embodiments illustrated to describe the invention include a four valve per cylinder compression ignition engine. However, the present invention may be used in any applications having multiple intake/exhaust valves controlled simultaneously by a single camshaft lobe. Similarly, while the representative embodiments of the present invention include independently operable hydraulic lash adjusters, the invention also includes a valvetrain having mechanical lash adjustment with two pushrods engaging a single lifter or tappet.

Multiple cylinder internal combustion engine 10 includes a camshaft 12 disposed within an engine block 14, and may be referred to as a cam-in-block engine. Each cylinder 16 (only one of which is shown) includes a reciprocating piston 18 coupled by a connecting rod 20 to a crankshaft (not shown). Cylinder head 22 is secured to engine block 14 and provides conventional intake and exhaust passages (not shown) coupled to corresponding ports in cylinder head 22(not shown) associated with gas exchange valves 28, which include intake valves 30, 32 and exhaust valves 36, 38. Cylinder head 22 includes conventional hardware such as valve guides, seats, etc. (not shown) associated with operation of gas exchange valves 28. A fuel injector 40 delivers fuel to cylinder 16 in response to a signal provided by an associated engine controller. Although a direct injection engine is illustrated in FIG. 1, the present invention may be used in engines having other fuel injection strategies, such as port injection, for example.

Engine 10 includes a valvetrain 50 to control intake of air and/or fuel (for port injected engines) into cylinder 16 and exhaust of combustion gases. Valvetrain 50 includes valves 28, valve springs 52, rocker arms 54, pushrods 56, and lifters 58, sometimes referred to as tappets or cam followers. As best illustrated in FIG. 2, camshaft 12 includes lobes 76 to actuate valves 28. For each cylinder 16, camshaft 12 includes a lobe 76 to operate associated intake valves 30, 32 and a lobe 78 to operate associated exhaust valves 36 and 38. In the representative embodiment of the present invention illustrated in FIGS. 1-3, cam lobe 76 has an associated cam follower or lifter 82 coupled to a pair of corresponding pushrods 88, 90 that drive corresponding rocker arms 100,102 to actuate intake valves 32, 30 in tandem. Similarly, cam lobe 78 has an associated cam follower or lifter 84 coupled to a pair of corresponding pushrods 92, 94 that drive corresponding rocker arms 106, 108 to actuate exhaust valves 38, 36. As described in greater detail with reference to FIGS. 4 and 5, each lifter 82, 84 includes independently operable hydraulic lash adjusters to adjust lash associated with each of the pair of associated pushrods, rocker arms, and valves.

In operation, lifter 82 contacts lobe 76 of camshaft 12. As camshaft 12 rotates, lobe 76 raises lifter 82 and associated pushrods 88, 90 that exert corresponding forces on associated rocker arms 100, 102. Each rocker arm 100, 102 pivots in a single plane about an integral ball/socket fulcrum or pivot point 120 with the ball supported by an associated fulcrum 126 secured to cylinder head 22 as known in the art. Rocker arms 100, 102 translate the generally upward motion from pushrods 88, 90 to a generally downward motion to move intake valves 30, 32 against associated springs 52 to open the intake ports. As camshaft 12 continues rotating, lifter 82 follows the profile of lobe 76 and begins a generally downward motion so that the associated springs 52 close intake valves 30, 32. Actuation of exhaust valves 36, 38 proceeds in a similar manner based on the profile of lobe 78.

As illustrated in FIGS. 1-3, a method for operating engine 10 and valvetrain 50 according to the present invention includes actuating at least two gas exchange valves, such as intake valves 30, 32 or exhaust valves 36, 38, substantially simultaneously using at least two corresponding pushrods (88, 90 or 92, 94) and rocker arms (100, 102 or 106, 108) coupled to a common cam follower (82 or 84). As illustrated and described with reference to FIGS. 5 and 6, each cam follower 82, 84 may include an independently operable hydraulic lash adjuster to independently adjust lash associated with each pushrod and rocker arm. Alternatively, mechanical lash adjustment may be provided with two pushrods per lifter easily accommodated by otherwise conventional four-valve per cylinder engines. Conventional mechanical lash adjustment may use a screw adjuster at the rocker arm on the pushrod end. The pushrod is typically a ball-cup end with the rocker arm adjuster screw having a ball end locked in position with a nut.

As best illustrated in the top view of a representative valvetrain 50 in FIG. 3, the present invention uses rocker arms 54 including rocker arms 100, 102, 106, and 108 having a one-piece body with a structurally integral flared portion to create a socket for engaging a pivot ball mounted on a fulcrum 120 (FIG. 1.) Each rocker arm 54 uses a coplanar cold-formed or stamped steel construction with a narrow width profile to facilitate packaging. As shown in FIG. 3, valves 30, 32 are positioned at different distances relative to pushrods 88, 90 and require substantially different lengths for associated rocker arms 100, 102. In one embodiment of the present invention, rocker arm 100 is about 40% longer than rocker arm 102. However, use of a thin profile coplanar rocker arm with a ball/socket pivot according to the present invention allows appropriate positioning of the ball/socket fulcrums 120, 122 to provide substantially identical rocker ratios to produce substantially identical valve motion for valves 30, 32. For example, computer analysis indicates that valve lift profiles for pairs of valves in a representative valvetrain according to the present invention are within 0.025 millimeters (mm) of each other with rocker arm lengths that differ by about 40%. As known by those of ordinary skill in the art, the rocker ratio is generally understood to be the ratio of the distance between pushrod 88 and fulcrum 120 relative to either the distance between pushrod 88 and the stem of valve 32, or the distance between fulcrum 120 and the stem of valve 32. The rocker ratio may also be used to refer to the ratio of valve lift to cam lift.

Figure 4:
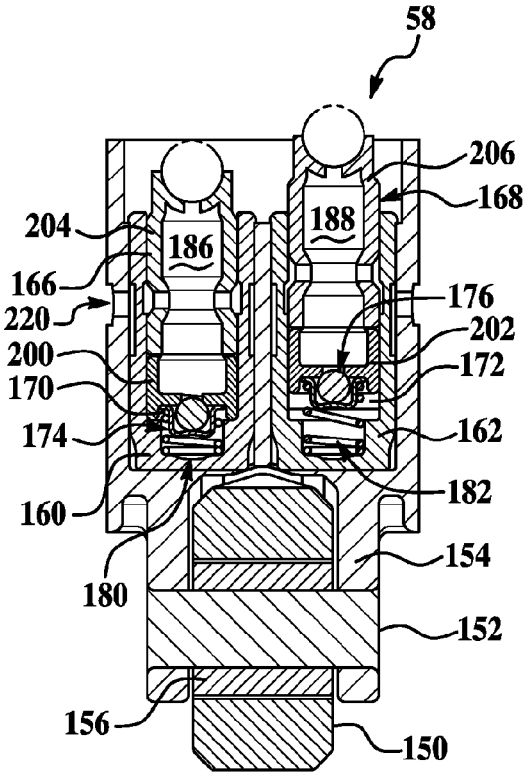
FIG. 4 is a cross-section illustrating a lifter with independent hydraulic lash adjusters for operating a pair of valves according to one embodiment of the present invention.
Figure 5:
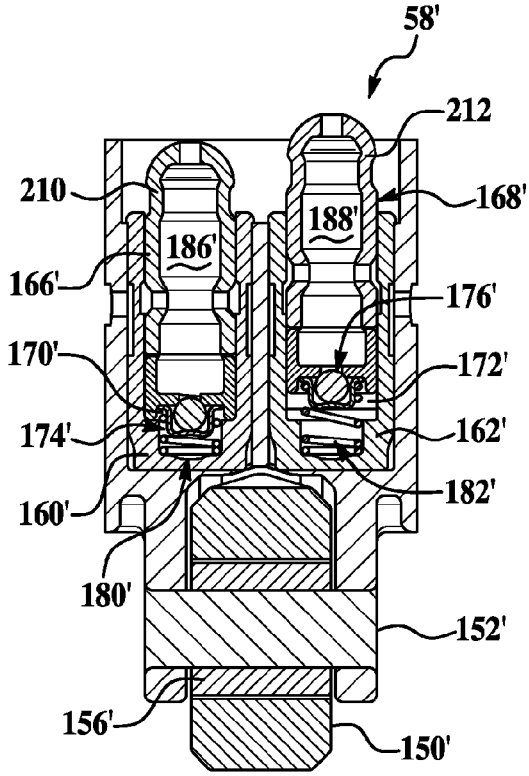
FIG. 5 is a cross-section illustrating another embodiment of a lifter with independent hydraulic lash adjusters according to the present invention.

FIGS. 4 and 5 illustrate alternative embodiments of a lifter having at least two independent hydraulic lash adjusters according to the present invention. Lifters 58 and 58' have similar construction and operating principles so that the following description with reference to lifter 58 applies also to lifter 58' with differences as noted. Primed reference numerals (such as 58') are used to designate components or features having similar construction and operation as described with reference to the unprimed reference numerals.

Lifter 58 is a cam follower or tappet that includes a roller 150 mounted for rotation about an axle 152 secured to housing or body 154. A bearing 156 or similar device facilitates rotation of roller 150 about axle 152 when in contact with a corresponding camshaft lobe. Housing 154 includes axial bores with corresponding sleeves 160, 162 fixed therein and each having a closed end and an open end. Each sleeve 160, 162 includes an axially movable plunger 166, 168 disposed therein to define a variable volume high-pressure chamber 170, 172 between the closed end and the plunger. Check valves 174, 176 are disposed within corresponding high pressure chambers 170, 172 to control flow of hydraulic fluid from reservoirs 186, 188 disposed within plungers 166, 168 into chambers 170, 172. Springs 180, 182 act on associated plungers 166, 168 to reduce lash when hydraulic pressure is reduced, such as when the engine is shut off, for example.

Lifter 58 includes two-part plungers 166, 168 with a lower plunger member or base 200, 202 and an upper plunger member or coupling 204, 206. Upper plunger members 204, 206 include a generally concave hemispherical geometry forming a socket for coupling to a corresponding pushrod having a generally convex hemispherical end or ball-shaped end. Lifter 58' has two-part plungers 166', 168' with upper members or couplers 210, 212 having generally convex hemispherical or ball-shaped ends adapted for coupling to corresponding pushrods having concave hemispherical ends forming a socket. As shown in FIGS. 4 and 5, the upper members of the plungers include an orifice to supply lubricating oil through a channel in corresponding pushrods to the corresponding rocker arms.

In operation, independent mechanical or hydraulic lash adjusters essentially eliminate any lash or clearance between the valve train components under varying operating and ambient conditions to provide consistent and reliable valve actuations including repeatable valve opening and closing times and peak lift values. As the length of an associated pushrod varies due to temperature variation or wear, hydraulic fluid from a pressurized supply enters lifter 58 through a transverse bore 220 in housing 154 and enters reservoirs 186, 188. A small amount of hydraulic fluid passes through check valves 174,176 into high-pressure chambers 170, 172 moving plungers 166, 168 away from closed end of sleeves 160, 162 to remove any lash or clearance between couplers 204, 206 and corresponding pushrods and rocker arms. As such, the force generated by the cam lobe rotating in contact with roller 150 is transferred through housing 154 to sleeves 160, 162 and through the hydraulic fluid within chambers 170, 172 to plungers 166, 168. If the pushrod increases in length due to thermal expansion, hydraulic fluid escapes very slowly from chambers 170, 172 between plungers 166, 168 and sleeves 160, 162 to reduce the volume contained within an associated pressure chamber 170 or 172.

The lash adjusters associated with each lifter operate independently from one other so that the present invention can more precisely synchronize actuation of valves associated with the lifter as compared to a bridged implementation using a single pushrod and lash adjuster. As such, the individual lash compensation accommodates variations in valve spring force, valve and/or valve seat wear, thermal effects, etc. to provide coupled, synchronous motion for each valve pair.

While the best mode for carrying out the invention has been described in detail, those familiar with the art to which this invention relates will recognize various alternative designs and embodiments for practicing the invention as defined by the following claims.

What is claimed is:

1. A multiple cylinder internal combustion engine having a camshaft-driven valvetrain with a camshaft disposed within an engine block, the engine including at least two valves operated by a common camshaft lobe, the engine comprising:

a cam follower in contact with the common camshaft lobe and at least two pushrods, each pushrod associated with one of the at least two valves;

a first rocker arm associated with a corresponding pushrod and having a first length and a first pivot point defining a first rocker ratio corresponding to distance between an associated pushrod and the first pivot point relative to distance between an associated valve stem and the first pivot point; and a second rocker aim associated with a corresponding pushrod and having a second length and a second pivot point defining a second rocker ratio corresponding to distance between an associated pushrod and the second pivot point relative to distance between an associated valve stem and the second pivot point, wherein the first and second lengths are substantially different and the first and second rocker ratios are substantially identical.

2. The engine of claim 1 wherein the cam follower comprises:

at least two independent lash adjusters, each lash adjuster associated with a corresponding pushrod and rocker aim.

3. The engine of claim 1 wherein the cam follower comprises:

a roller follower having at least two independent hydraulic lash adjustment mechanisms, each lash adjustment mechanism associated with a corresponding pushrod and rocker arm.

4. The engine of claim 1 wherein the cam follower comprises:

a housing;

a roller in contact with a camshaft lobe and rotatable about an axle mounted in the housing;

a first sleeve disposed within a first bore in the housing and having a closed end and an open end;

a first plunger disposed within the first sleeve and defining a first high-pressure chamber between the closed end and the first plunger;

a first check valve disposed between the first plunger and the first sleeve for controlling flow of hydraulic fluid from the first plunger into the first high-pressure chamber, the hydraulic fluid in the high-pressure chamber along with the plunger spring operating to remove lash associated with a first push rod, first rocker arm, and first valve;

a second sleeve disposed within a second bore in the housing and having a closed end and an open end;

a second plunger disposed within the second sleeve and defining a second high-pressure chamber between the closed end and the second plunger; and a second check valve disposed between the second plunger and the second sleeve for controlling flow of hydraulic fluid from the second plunger into the second high-pressure chamber, the hydraulic fluid in the second high-pressure chamber along with the plunger spring operating to remove lash associated with a second push rod, second rocker arm, and second valve.

5. The engine of claim 4 wherein each of the first and second plungers comprises:

a lower plunger member contacting a corresponding check valve; and an upper plunger member disposed between the lower plunger member and an associated pushrod, the upper plunger member adapted for coupling with the associated pushrod and having an orifice for supplying hydraulic fluid to the associated pushrod.

6. The engine of claim 5 wherein the upper plunger member includes an orifice in a generally convex hemispherical end for coupling to the associated pushrod.

7. The engine of claim 5 wherein the upper plunger member includes an orifice in a generally concave hemispherical end for coupling to the associated pushrod.

8. A valvetrain for a multiple cylinder internal combustion engine having a camshaft disposed within an engine block for operating two valves to both open or close independently and substantially simultaneously from a single camshaft lobe, the valvetrain comprising:

a lifter having a roller for contacting the single camshaft lobe and including first and second lash adjusters;

first and second rocker arms each associated with a respective one of the two valves; and first and second pushrods extending between respective first and second lash adjusters and first and second rocker arms, the first and second pushrods moving in the same direction substantially simultaneously to open or close respective valves.

9. The valvetrain of claim 8 wherein the two valves are intake valves associated with one of the cylinders.

10. The valvetrain of claim 8 wherein the two valves are exhaust valves associated with one of the cylinders.

11. The valvetrain of claim 8 wherein the first and second lash adjusters comprise hydraulic lash adjusters having a high-pressure chamber containing a variable amount of hydraulic fluid to remove lash from a respective pushrod, rocker arm, and valve assembly.

12. The valvetrain of claim 8 further comprising:

a fulcrum associated with each of the first and second rocker arms, the fulcrum secured to a cylinder head of the engine and having a ball or socket pivot base cooperating with and supporting an associated socket or ball, respectively, of a corresponding rocker arm such that the rocker arm pivots about the base in a plane of the rocker arm during actuation of a corresponding valve.

13. The valvetrain of claim 12 wherein the first and second rocker arms are substantially different in length.

14. The valvetrain of claim 13 wherein the first and second rocker arms have substantially identical rocker ratios.

15. A lifter for an internal combustion engine having a pushrod valvetrain with a camshaft disposed within an engine block, the lifter comprising:

a housing;

a roller for contacting a camshaft lobe, the roller being mounted for rotation about an axle mounted in the housing; and first and second hydraulic lash adjusters each at least partially disposed within the housing and having one end adapted for coupling with a corresponding one of first and second pushrods to move the first and second pushrods in the same direction substantially simultaneously in response to movement of the housing, the first and second hydraulic lash adjusters each including a variable volume chamber fillable with hydraulic fluid to adjust axial distance of the corresponding pushrod relative to the housing and the roller.

16. The lifter of claim 15 wherein the one end of each of the first and second hydraulic lash adjusters comprises a generally hemispherical end for coupling with a corresponding generally hemispherical end of one of the pushrods.

17. The lifter of claim 16 wherein the corresponding generally hemispherical end is convex.

18. The lifter of claim 16 wherein the corresponding generally hemispherical end is concave.

19. The lifter of claim 16 wherein the first and second hydraulic lash adjusters each comprise:

a sleeve disposed within a corresponding bore in the housing and having a closed end and an open end;

a plunger disposed within the sleeve and axially movable relative thereto defining a variable volume high-pressure chamber between the closed end and the plunger; and a check valve disposed between the plunger and the sleeve for controlling flow of hydraulic fluid from the plunger into the variable volume high-pressure chamber.

* * * * *

UNITED STATES PATENT AND TRADEMARK OFFICE

CERTIFICATE OF CORRECTION

PATENT NO. : 7,617,807 B2
APPLICATION NO. : 11/164620
DATED : November 17, 2009
INVENTOR(S) : Diggs et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 308 days.

Signed and Sealed this

Nineteenth Day of October, 2010

David J. Kappos

David J. Kappos
*Director of the United States Patent and Trademark Office*